US008272499B2

(12) United States Patent
Mehrhoff et al.

(10) Patent No.: US 8,272,499 B2
(45) Date of Patent: Sep. 25, 2012

(54) METHOD AND APPARATUS FOR DIVIDING AND/OR SEPARATING A LAUNDRY BATCH, IN PARTICULAR A LAUNDRY CAKE OR THE LIKE

(75) Inventors: Friedhelm Mehrhoff, Hille (DE); Andreas Olivieri, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 119 days.

(21) Appl. No.: 12/833,690

(22) Filed: Jul. 9, 2010

(65) Prior Publication Data

US 2011/0088995 A1 Apr. 21, 2011

(30) Foreign Application Priority Data

Jul. 15, 2009 (DE) ..... 10 2009 033 433
Aug. 1, 2009 (DE) ..... 10 2009 035 744
May 14, 2010 (DE) ..... 10 2010 020 556

(51) Int. Cl.
*B65G 47/26* (2006.01)

(52) U.S. Cl. ..... 198/453; 68/22 R; 241/223

(58) Field of Classification Search ..... 198/443, 198/453; 241/223, 225; 68/22 R, 46, 270, 68/273, 903
See application file for complete search history.

(56) References Cited

U.S. PATENT DOCUMENTS 3,603,122 A * 9/1971 Sulzmann ..... 68/22 R
4,159,632 A * 7/1979 Grantham ..... 68/270
4,306,495 A * 12/1981 Grantham ..... 68/22 R
4,467,530 A * 8/1984 Fesmire et al. ..... 68/210
6,287,066 B1 * 9/2001 Heinz et al. ..... 198/455
6,666,393 B2 * 12/2003 Weir ..... 241/223
2010/0275793 A1 * 11/2010 Eaves ..... 198/804

* cited by examiner

*Primary Examiner* — James R Bidwell
(74) *Attorney, Agent, or Firm* — Laurence P. Colton; Smith Risley Tempel Santos LLC

(57) ABSTRACT

A method and apparatus in which laundry cakes (10), formed when washed laundry articles are for the most part freed in a dewatering press of the treatment liquid bound in them giving rise to a laundry cake (10) consisting of coherent laundry articles, are divided from the end face (15) by a roller-like divider (20) which can be driven in rotation about a horizontal axis of rotation (31), which axis of rotation (21) runs parallel to the end face (15) of the laundry cake (10) to be divided, and an effective division of the laundry cake (10) which takes care of the laundry articles is carried out.

22 Claims, 4 Drawing Sheets

METHOD AND APPARATUS FOR DIVIDING AND/OR SEPARATING A LAUNDRY BATCH, IN PARTICULAR A LAUNDRY CAKE OR THE LIKE

STATEMENT OF RELATED APPLICATIONS

This patent application is based on and claims the benefit of German patent application nos. 10 2009 033 433.5 having a filing date of 15 Jul. 2009, 10 2009 035 744.0 having a filing date of 1 Aug. 2009, and 10 2010 020 556.7 having a filing date of 14 May 2010, all of which are incorporated herein in their entireties by this reference.

BACKGROUND OF THE INVENTION

1. Technical Field

The invention relates to a method for dividing and/or separating a laundry batch, in particular a laundry cake or the like. The invention relates, further, to a corresponding apparatus.

2. Prior Art

In commercial laundries, washed laundry articles are delivered batchwise, as a laundry batch in the form of a laundry cake or laundry heap, for subsequent processing. For example, in a dewatering device, such as a dewatering press, washed laundry articles are dewatered, during which they are separated from a large part of the liquid bound in them (bound liquor). In this case, a laundry cake is obtained, which is usually divided before the laundry articles are treated further, in particular dried, mangled and/or laid together by folding.

It is known to loosen laundry cakes by pressing them together laterally. The laundry cake, by being loosened in this way, is divided only inadequately. Moreover, when the laundry cake is pressed together laterally, the laundry articles are exposed to high mechanical loads.

BRIEF SUMMARY OF THE INVENTION

The object on which the invention is based is to provide a method and an apparatus whereby an effective division and/or separation of the laundry batch, in particular of the laundry cake or laundry heap, is ensured, while at the same time the greatest possible care of the laundry articles is taken.

A method for achieving the object is a method for dividing a laundry batch, in particular a laundry cake consisting of pressed-together laundry articles, the laundry batch being transported from a conveyor to a dividing device, and the laundry batch being divided from its end face by the dividing device. Since the dividing device divides the laundry batch, such as a laundry heap, a laundry knot or a laundry cake, from its end face, the laundry articles are drawn out of the laundry batch gradually. This results in an effective division of the laundry batch, while the laundry articles can at the same time also be at least partially separated. Since the laundry articles are drawn off from the end face of the laundry batch, when the latter is being divided they are also not exposed to any appreciable mechanical loads and are therefore given the greatest possible care.

Furthermore, there is provision whereby the laundry batch is divided by the dividing device at the rear end of the conveyor on the front end face, as seen in the transport direction of the conveyor. As a result, the conveyor is available over its entire length in order to transport the laundry batch to the dividing device and, if necessary, to press the front end face of the laundry batch against the dividing device. Thus, the dividing device can gradually draw the laundry articles out of the laundry batch continuously and, if appropriate, at the same time separate them at least partially, and, moreover, the laundry batch, specifically, above all, also a laundry cake, can be divided completely.

In a preferred refinement of the method, there is provision for driving the dividing device in rotation about a horizontal axis of rotation. As a result, the laundry articles are drawn out of the laundry batch by the dividing device transversely with respect to the transport direction of the conveyor, specifically, preferably, upward with respect to an upper strand of the conveyor. This results in an especially careful and reliable division of the laundry articles, only very low mechanical loads being exerted upon the laundry articles by the laundry article being drawn off upwardly.

An apparatus for achieving the object initially mentioned is an apparatus for dividing a laundry batch, in particular a laundry cake consisting of pressed-together laundry articles, with a conveyor which is assigned at least one dividing device which has at least one divider drivable in rotation about a horizontal axis of rotation. Accordingly, at least one dividing device is provided, which has at least one divider drivable in rotation about a horizontal axis of rotation. Due to the horizontal axis of rotation of the at least one divider, the latter is moved past the laundry batch so that it can gradually draw off the laundry articles from this or draw them out of the laundry batch. The horizontal axis of rotation of the at least one divider makes it possible, in particular, to draw the laundry articles up in front of the laundry batch, with the result that they can carefully be separated from the laundry batch and transported away.

Preferably, there is provision whereby the dividing device has a single divider drivable in rotation, which may be of roller-like design, for example in the manner of a dividing or separating roller. As a result, the divider can constantly, in particular gradually, draw laundry articles out of the end face of the laundry batch, preferably the laundry cake, or separate them from the laundry batch.

In a preferred refinement of the apparatus, the horizontal axis of rotation of the divider runs transversely with respect to the transport direction of the conveyor. As a result, the laundry batch is transported continuously to the divider by the conveyor, and the laundry batch is continuously shortened and thereby increasingly divided by the divider.

There is provision, furthermore, for arranging the at least one divider at a rear end of the conveyor. The conveyor can thereby transport the entire laundry batch to the divider, with the result that the laundry batch can be divided completely.

In a preferred refinement of the invention, there is provision for arranging the axis of rotation of the divider at a distance above an upper strand of the conveyor. The axis of rotation is preferably located approximately at half the height of the laundry batch. Moreover, there is preferably provision for providing the divider of roller-like design with a diameter which is at least as large as the height of the laundry batch. As a result, the divider can run past an entire leading end face of the laundry batch and thus draw off the laundry articles from the laundry batch effectively.

According to an especially advantageous refinement of the apparatus, the divider of roller-like design is provided with a plurality of blades. Each of the preferably identically designed blades is provided with a radially directed connecting plate emanating from the axis of rotation and with a blade plate running tangentially with respect to the outer longitudinal edge of the connecting plate. The blade plate operates on the principle of a blunted knife which draws the laundry articles out of the laundry batch without damaging them. Instead, the blade plate of each blade causes one or even more laundry articles to be laid around it on the outside and to be retained merely at a longitudinal edge.

In a preferred design of the apparatus, the longitudinal edge of each connecting plate runs parallel to the axis of rotation of the roller-like divider, while the respective blade plate has longitudinal edges running obliquely with respect to the axis of rotation. In particular, the longitudinal edges of the blade plates of successive blades are inclined differently, in that the leading longitudinal edge of one blade descends toward one end face of the divider with respect to the axis of rotation, while the leading longitudinal axis of the following blade descends toward the opposite end face of the divider with respect to the axis of rotation. Thus, the laundry articles can, where appropriate, slide along the longitudinal edges, with the result that the mechanical loads exerted upon the laundry articles by the divider are likewise reduced.

There is provision, further, whereby a gap is formed between a rear end of the upper strand of the conveyor and a longitudinal edge, directed toward the rear end of the upper strand, of each blade plate of the roller-like divider. This gap makes it possible, where appropriate, to move the roller-like divider opposite to its main direction of rotation when, for example, individual laundry articles have been caught on the divider or virtually the entire laundry batch is divided. In this case, individual laundry articles still remaining on the conveyor can then be drawn down from the conveyor through the gap by the divider.

According to a preferred development of the invention, there is provision for driving the roller-like divider for dividing the laundry batch in rotation in such a way that the longitudinal edges, engaging on the laundry article, of the blade plates run up in front of the end face of the laundry batch with respect to the plane of the upper strand. The separated laundry articles detached from the laundry batch can thereby be transported away especially carefully beyond the roller-like divider.

Furthermore, there may be provision for arranging the conveyor so as to ascend toward the divider in the transport direction. As a result, the laundry articles detached from the laundry cake pass, when being divided, onto a higher level which makes it possible to transport the individual laundry articles further on by means of gravity conveyors or to dump the laundry articles into a laundry truck.

It is conceivable to develop the apparatus by means, assigned to opposite longitudinal margins of the conveyor, for reducing the width of the laundry batch, in particular of the laundry cake, transversely with respect to the transport direction of the conveyor. These may be any means which extend over the entire length of the conveyor, but also only over a part region of the latter, preferably just in front of the roller-shaped divider. In the simplest instance, these means may be lateral guide walls for the laundry batch which converge slightly in the direction of the roller-like divider and thereby press the laundry batch together laterally, with the result that the retention of the laundry articles in the laundry batch is reduced and it thereby becomes easier subsequently to divide the laundry batch by means of the roller-like divider.

A further independent method for achieving the object initially mentioned is a method for separating laundry articles from a laundry batch, preferably a laundry cake, the laundry batch first being divided by a dividing device, and the laundry articles of the divided laundry batch thereafter being separated by a separating device. This may also be a preferred development of the method described above. In this method, the laundry batch, which may preferably be a laundry cake, a laundry heap or a laundry knot, is first divided by means of a dividing device, and the laundry articles of the divided laundry batch are thereafter separated by a separating device. The division of the laundry batch which takes place before separation causes the laundry articles of the laundry batch to be loosened and also already to be present partially as individual laundry articles in the loosened laundry heap. The automatic separation of the laundry articles from this laundry heap can be carried out more simply by means of the separating device. What is thus achieved, above all, is that the laundry articles are separated more reliably and the separating capacity of the separating device is increased. The separating device may be any separating device known per se.

In a preferred refinement of the invention, the divided laundry batch is delivered directly, after the division of the laundry articles, to a store or to a delivery conveyor of the separating device. It is also conceivable to deposit the divided laundry batch on a conveyor which transports it to the separating device. Alternatively, there may be provision for intercepting the laundry articles of the divided laundry batch in a laundry truck or the like which is then moved to the separating device which extracts the laundry articles directly from the laundry truck and separates them.

BRIEF DESCRIPTION OF THE DRAWINGS

A preferred exemplary embodiment of the invention is illustrated in more detail below by means of the drawing in which.

DETAILED DESCRIPTION OF PREFERRED EMBODIMENTS

Figure 1:
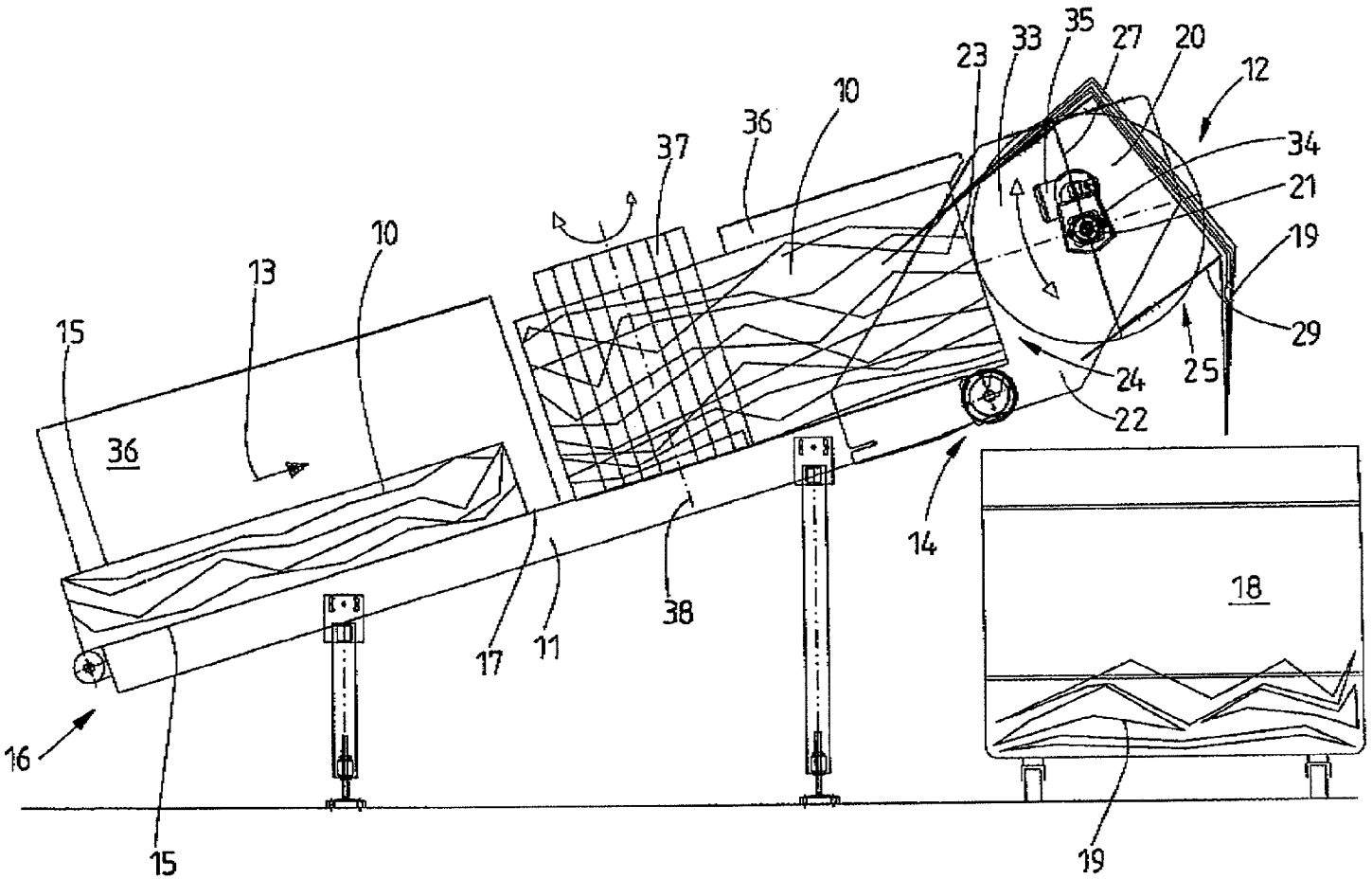
FIG. 1 shows a diagrammatic side view of the apparatus.
Figure 2:
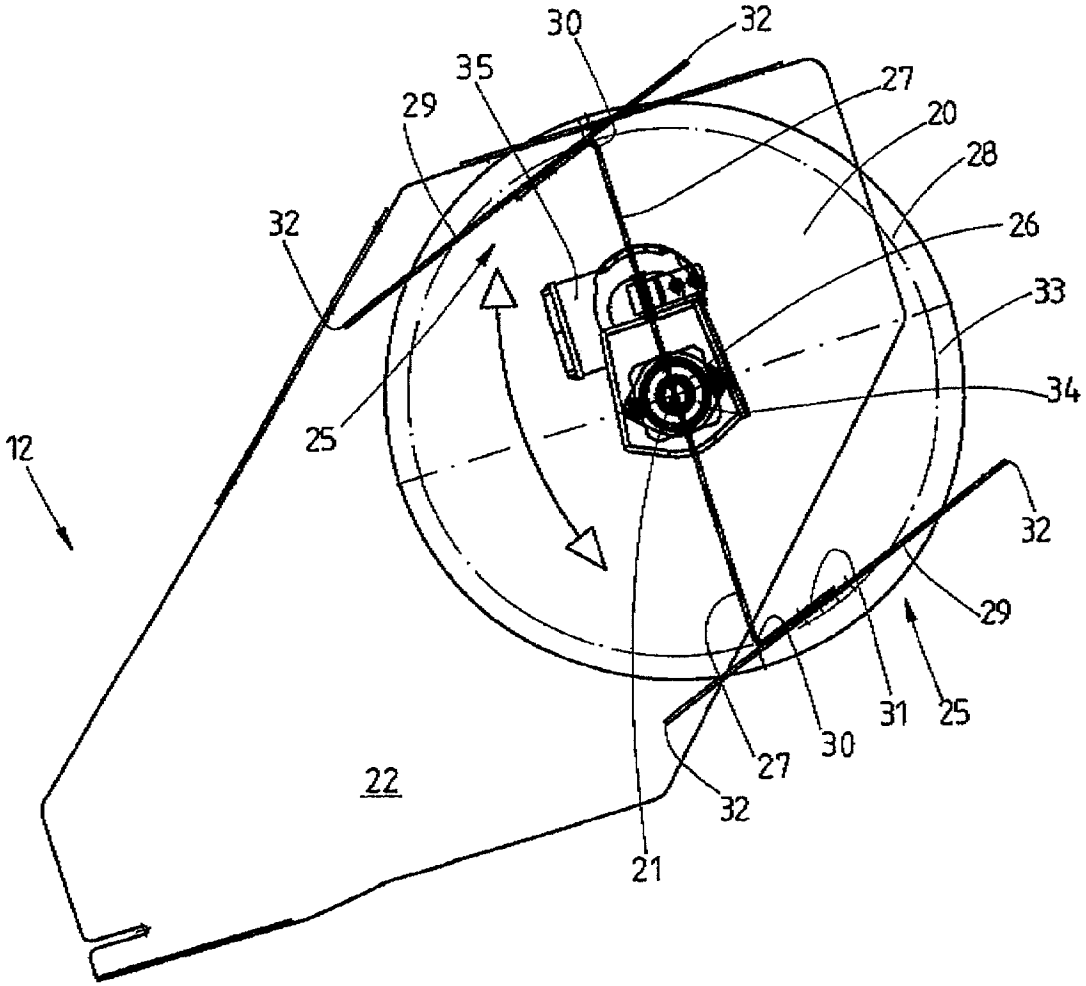
FIG. 2 shows an enlarged side view of a divider of the apparatus of FIG. 1.

The apparatus shown in the figures is arranged in a laundry, downstream of a dewatering device in which a laundry batch consisting of a larger number of laundry articles is dewatered by being pressed together. In this case, a laundry cake 10 is obtained. The laundry cake 10, which is cylindrical in the exemplary embodiment shown, comes from a dewatering press having a cylindrical press basket. The invention is explained below with reference to such a laundry cake 10. However, the invention is not restricted to this; on the contrary, it relates to the division of all types of laundry batches, such as, for example, also laundry heaps, laundry knots or the like.

The apparatus has a conveyor 11 which, in the exemplary embodiment illustrated, is a belt conveyor, and a dividing device 12. The dividing device 12 is assigned to the rear end 14 of the conveyor 11, as seen in the transport direction 13.

The respective laundry cake 10 is fed, lying on a flat end face 15, from the dewatering press onto a front end region 16 of the conveyor 11. The laundry cake 10 thereby lies with its lower end face 15 on an upper strand 17 of the conveyor 11.

The conveyor 11 shown here has a length which is sufficient for receiving two successive laundry cakes 10. However, the conveyor 11 may also be of shorter or longer design, so that it receives only one laundry cake 10 or more than two laundry cakes 10. In the exemplary embodiment shown, the conveyor 11 runs obliquely, specifically so as to rise slightly in the transport direction 13. As a result, the laundry cake 10 passes onto a level which makes it possible to catch, under the dividing device 12, a laundry truck 18 for intercepting the laundry articles 19 detached from the laundry cake 10 by the dividing device 12 and at the same time at least partially separated. However, the laundry articles 19 drawn off from the laundry cake 10 may also be transported away in another manner, for example by means of a following conveyor or a chute, or may be delivered to a separating device following the dividing device 12 in the transport direction 13, for example may pass directly into a store of the separating device.

The dividing device 12 having a roller-like divider 20, which may also be designated as a dividing roller, can be driven in rotation about a horizontal axis of rotation 21. The horizontal axis of rotation 21 runs transversely (at 90°) with respect to the transport direction 13 of the conveyor 11. The roller-like divider 20 is mounted rotatably with its axis of rotation 21 between two parallel upright carrying walls 22. The carrying walls 22 are fastened, in the region of the rear end 14 of the conveyor 11, to opposite longitudinal margins of the latter.

The axis of rotation 21 of the divider 20 is located at a distance behind the rear end 14 and above the upper strand 17 of the conveyor 11 (FIG. 1). In the exemplary embodiment shown, the axis of rotation 21 is at a distance behind the rear end 14 of the conveyor 11 which corresponds approximately to half the diameter of the roller-like divider 20. The distance of the axis of rotation 21 of the divider 20 above the upper strand 17 of the conveyor 11 is likewise approximately as great as half the diameter of the roller-like divider 20. The diameter of the roller-like divider 20 corresponds at least approximately to the customary height of a laundry cake 10.

By the dividing device 12 being arranged behind the conveyor 11, as described above, the upright end face 23, lying at the front in the transport direction 13, that is to say leading, of the laundry cake 10 comes into contact with the roller-like divider 20, specifically essentially over its entire area. In particular, the roller-like divider 20 extends over the entire height of the laundry cake 10 when the latter is located in front of the dividing device 12. Further, by the axis of rotation 21 of the roller-like divider 20 being at a distance from the rear end 14 of the conveyor 11, a narrow gap 24 occurs between the roller-like divider 20 and the rear end 14 of the upper strand 17 of the conveyor 11.

In the exemplary embodiment shown, the roller-like divider 20 has two identically designed opposite blades 25. The two blades 25 are fastened to a shaft 26, the longitudinal axis of which lies on the axis of rotation 21 of the divider 20.

Each blade 25 has a connecting plate 27, projecting radially outward with respect to the shaft 26, and a blade plate 29, running around the axis of rotation 21 tangentially with respect to an imaginary circular path 28. In the exemplary embodiment shown, the connecting plates 27 of the two blades 25 lie in a common plane which runs through the axis of rotation 21. The tangentially running blade plates 29 are connected to an outer longitudinal margin 30 of the respective connecting plate 27. In the exemplary embodiment shown, the blade plates 29 are releasably fastened, specifically screwed, to the longitudinal margin 30 of each connecting plate 27 on angled marginal connecting strips 31.

Figure 4:
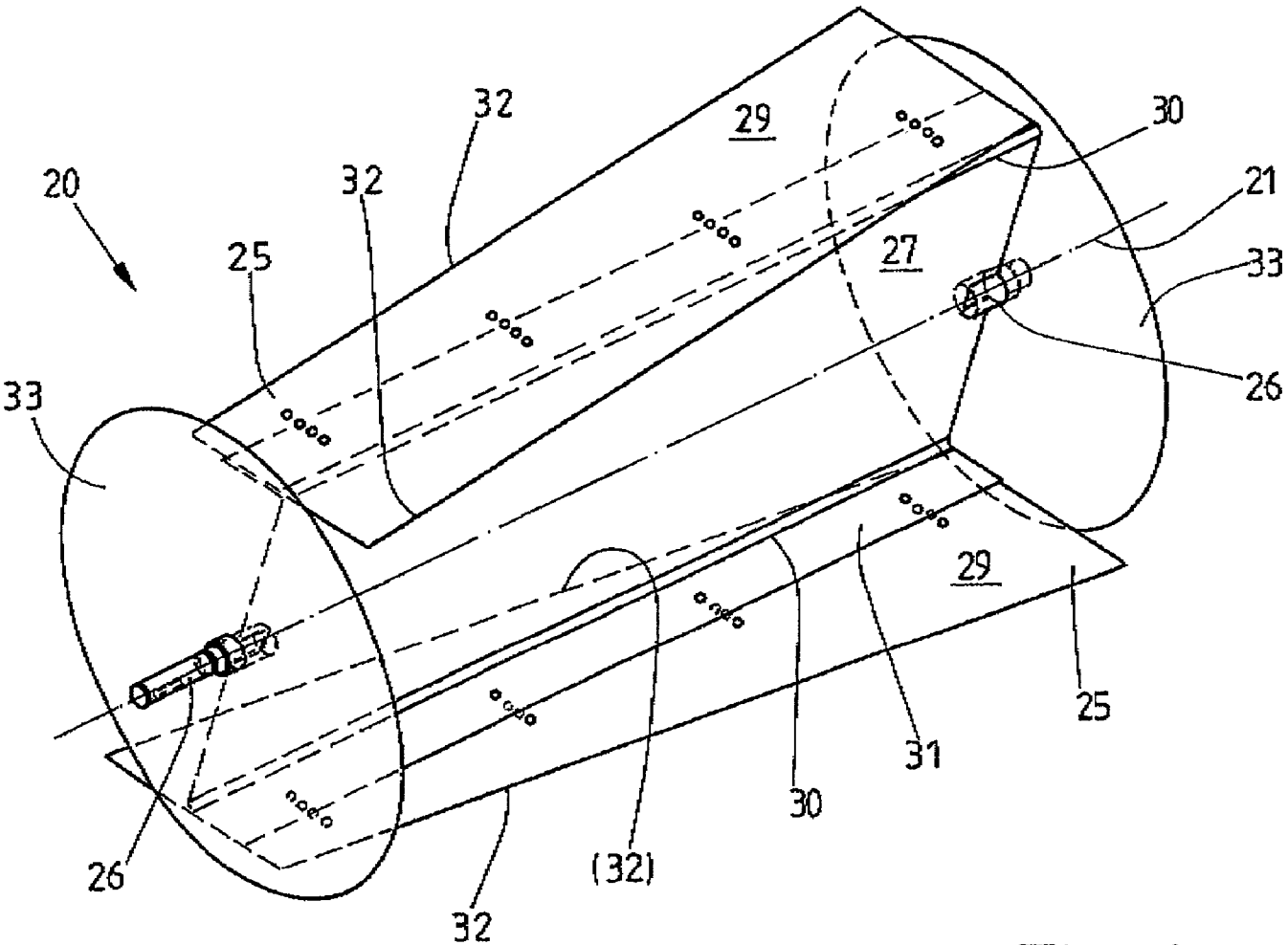
FIG. 4 shows a perspective illustration of the roller-like divider.

Opposite longitudinal edges 32 of each blade plate 29 run obliquely with respect to the axis of rotation 21. In the exemplary embodiment shown, the opposite longitudinal edges 32 of each blade plate 29 are obliquely directed equally, so that the longitudinal edges 32 of the respective blade plate 29 run parallel to one another. The two blade plates 29 are connected to the connecting plates 27 in a relative arrangement such that the longitudinal edges 32 of one blade plate 29 are inclined in a direction other than that of the longitudinal edges 32 of the other blade plate 29 (FIG. 4).

Moreover, the roller-like divider 20 has circular end walls 33 fastened on opposite sides of its shaft 26. The blades 25 are arranged between the end walls 33, those margins of the connecting plates 27 which point toward the end walls 33 being connected to the circular end walls 33 of the divider 20. This results in a stabilization of the blades 25.

The shaft 26 of the roller-like divider 20 is held with opposite end regions in bearings 34 which are connected to the carrying walls 22 arranged fixedly in the region of the rear end 14 of the conveyor 11. One of the bearings 34 is assigned a drive 35 of the roller-like divider 20, this drive preferably being an electric motor with an angular gear. However, other suitable drives may also be envisaged.

The opposite longitudinal margins of the conveyor 11 are assigned parallel upright side walls 36. The side walls 36 serve for guiding the laundry cakes 10 laterally on the conveyor 11.

Figure 3:
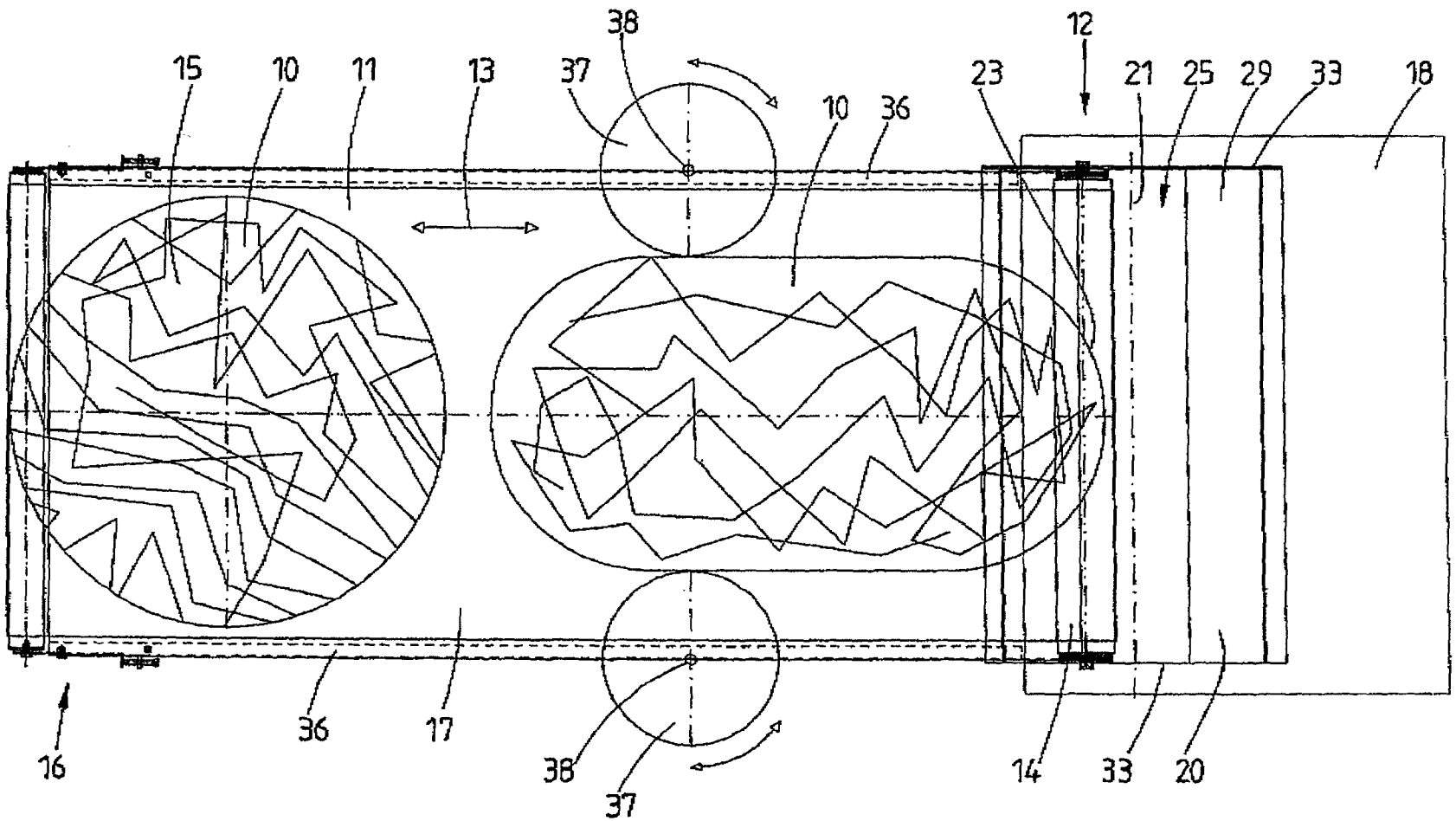
FIG. 3 shows a top view of the apparatus.

In the apparatus shown here (FIGS. 1 and 3), means for reducing the width of the laundry cake 10 transversely with respect to the transport direction 13 of the conveyor 11 are provided. These are rollers 37 which are freely rotatable or else can be driven in rotation. When the rollers 37 are driven, the drive may take place in opposite directions, in order, in the event of blockages of the dividing device 12, to move the end faces 23 of the laundry cake 10 briefly away from the divider 20. The rollers 37 are rotatable about axes of rotation 38 running perpendicularly with respect to the plane of the upper strand 17 of the conveyor 11. The rollers 37 are assigned to opposite longitudinal margins of the conveyor 11, specifically at a short distance in front of the dividing device 12. In the exemplary embodiment shown, the axes of rotation 38 of the rollers 37 lie on the longitudinal margins of the conveyor 11, in particular approximately in the plane of the opposite side walls 36. As a result, a passage for the laundry cakes 10, which has a reduced width in comparison with the width of the conveyor 11, is provided between the cylindrical casings of the opposite rollers 37, with the result that the laundry cakes 10 are pressed together between the rollers 37 and at the same time loosened, as a result of which they increase in height (FIGS. 1 and 3). However, apparatuses without these rollers 37 may also be envisaged, particularly when the side walls 36 converge in the transport direction 13.

Contrary to the exemplary embodiment shown, there may be provision whereby the side walls 36 converge toward the dividing device 12, that is to say in the transport direction 13, in that the distance between them decreases toward the dividing device 12. The laundry cakes 10 are thereby pressed together from the sides in the transport direction 13 and loosened, with the result that the height of the laundry cake 10 increases, as is indicated in FIG. 1.

However, it is also conceivable that the side walls 36 run parallel to one another in the transport direction 13, as illustrated in FIG. 3, and no rollers 37 are provided. In that case, no pressing together of the laundry cakes 10 takes place upstream of the dividing device 12.

The method according to the invention is explained below with reference to the apparatus described above:

The laundry cakes 10 coming from the dewatering press or another dewatering device are transported, specifically preferably continuously, by the conveyor 11 in the transport direction 13 to the dividing device 12 arranged at the rear end 14 of the conveyor 11. In this case, the laundry cakes 10 are pressed with their end face 23 leading in the transport direction 13 against the roller-like divider 20 of the dividing device 12, in particular the blades 25, specifically the blade plates 29. Thus, the laundry cake 10 is gradually divided by the dividing device 12 from its end face 23 leading in the transport direction 13, in that the dividing device 12 draws individual laundry articles 19 or a plurality of laundry articles 19 simultaneously out of the laundry cake 10 or gradually strips off laundry articles 19 from the end face 23 of the laundry cake 10. In this case, there is not only a division of the laundry cake 10, but also, for the most part or at least partially, a separation of the laundry articles 19 of the laundry cake 10.

The division of the laundry cake 10 taking place from the end face 23 takes place during the rotating drive of the roller-like divider 20 about its horizontal axis of rotation 21 which extends transversely, in particular perpendicularly, with respect to the transport direction 13. The drive of the divider 20 about the axis of rotation 21 normally takes place clockwise in relation to the illustration in FIG. 1, so that the blade plates 29 of the blades 25 move from below upward in front of the laundry cake 10 and thereby transport away the laundry articles 19 detached from the laundry cake 10 via an upper part of the roller-like divider 20 and dump the individual laundry articles 19 into the laundry truck 18.

It is also conceivable, however, to rotate the drum-like divider 20 briefly in the opposite direction, that is to say counterclockwise in relation to the illustration in FIG. 1, for example in order to carry out a division of a larger quantity of laundry articles 19 carried along or to transport individual left-behind laundry articles 19 of the already divided laundry cake 10 through the gap 24 between the rear end 14 of the conveyor 11 and the blades 25 of the divider 20 into the laundry truck 18. There is preferably provision also, if appropriate, for driving the conveyor 11 opposite to the transport direction 13, that is to say for reversing it. As a result, for example in the event of blockages of the dividing device 12, the laundry cake 10 is briefly transported back.

If rollers 37 are provided, as in the exemplary embodiment shown, the laundry cake 10 is pressed together upstream of the dividing device 12, with the result that it becomes higher. This causes a loosening of the laundry cake 10 upstream of the dividing device 12, so that the laundry cake 10 can be divided more easily by the dividing device 12, in particular, in this case, an at least partial separation of the laundry articles 19 can take place. However, the loosening of the laundry cakes 10 upstream of the dividing device 12 may also take place by means of side walls 36 which converge in the transport direction 13 and which, when the laundry cakes 10 are transported further on in the transport direction 13, continuously reduce the width of the laundry cake 10.

However, the method according to the invention can also be carried out with parallel side walls 36 and without rollers 37. The dividing device 12 then divides the laundry cakes 10, without these having previously been loosened by being pressed together.

The apparatus and method described above are also suitable for dividing or separating other types of laundry batches, for example laundry heaps, laundry knots or the like.

In a further method according to the invention, the laundry cake 10 or another laundry batch consisting of coherent laundry articles 19 is delivered to a separating device after division has taken place in the way described above. The separating device of a type known per se separates the loosened laundry articles of the laundry cake 10. For this purpose, individual laundry articles are grasped in succession by a gripper of the separating device and are drawn out of the laundry batch. The laundry articles 19 separated in each case is either deposited separately on a conveyor by the gripper of the gripping device or is transferred to a clamp of a following laundry treatment device, for example an input machine upstream of a mangle.

The loosened laundry articles 19 of the laundry cake 10 may be transferred directly from the dividing device 12 into a store or onto a delivery conveyor belt of the separating device. It is also conceivable, however, to intercept the loosened laundry articles 19 of the laundry cake 10 downstream of the dividing device 12 in the laundry truck 18. The laundry truck 18 is then moved to the separating device which gradually extracts the laundry articles 19 automatically from the laundry truck 18 and thereby separates them. Preferably, in this case, individual laundry articles 19 are drawn out of the laundry heap of the laundry truck 18 upwardly by a gripper of the separating device.

List of Reference Symbols

10 Laundry cake
11 Conveyor
12 Dividing device
13 Transport direction
14 Rear end
15 End face
16 Front end region
17 Upper strand
18 Laundry truck
19 Laundry article
20 Divider
21 Axis of rotation
22 Carrying wall
23 End face
24 Gap
25 Blade
26 Shaft
27 Connecting plate
28 Circular path
29 Blade plate
30 Longitudinal margin
31 Marginal connecting strip
32 Longitudinal edge
33 End wall
34 Bearing
35 Drive
36 Side wall
37 Roller
38 Axis of rotation

What is claimed is:

1. A method for dividing a laundry batch (10) consisting of pressed-together laundry articles (19), comprising the steps of:

transporting the laundry batch from a conveyor (11) to a dividing device (12), and dividing the laundry batch from an end face (23) of the laundry batch by the dividing device (12) by gradually drawing the laundry articles (19) out of the laundry batch (10).

2. The method according to claim 1, wherein the laundry batch is divided by the dividing device (12) at the rear end (14) of the conveyor (11) on the leading end face (23), as seen in the transport direction (13) of the conveyor (11), and in this case an at least partial separation of the laundry articles (19) of the laundry batch takes place.

3. The method according to claim 1, wherein the laundry articles (19) are at least partially separated during the division of the laundry batch.

4. The method according to claim 1, wherein the dividing device (12) is driven in rotation about an axis of rotation (21).

5. The method according to claim 4, wherein the axis of rotation (21) is arranged transversely with respect to the transport direction of the conveyor (11).

6. An apparatus for dividing a laundry batch (10) consisting of pressed-together laundry articles (19), comprising a conveyor (11) which is assigned at least one dividing device (12) that is positioned at an end face (23) of the laundry batch (10), and which has a single divider (20) drivable in rotation about a horizontal axis of rotation (21).

7. The apparatus according to claim 6, wherein the dividing device (12) has a single divider (20) drivable in rotation.

8. The apparatus according to claim 7, wherein the divider (20) is arranged at the rear end (14) of the conveyor (11).

9. The apparatus according to claim 6, wherein the horizontal axis of rotation (21) of the divider (20) runs transversely with respect to the transport direction (13) of the conveyor (11).

10. The apparatus according to claim 6, wherein the axis of rotation (21) of the divider (20) is arranged above an upper strand (17) of the conveyor (11).

11. The apparatus according to claim 10, wherein the upper strand (17) of the conveyor (11) runs so as to ascend toward the divider (20) in the transport direction (13).

12. The apparatus according to claim 6, wherein the divider (20) is a roller design.

13. The apparatus according to claim 12, wherein the axis of rotation (21) of the roller divider (20) is arranged above the upper strand (17) of the conveyor (11) by the amount of half the diameter of the roller-like divider (20).

14. The apparatus according to claim 6, wherein the roller divider (20) has a plurality of blades (25), each blade (25) being formed by a connecting plate (27) emanating radially from the axis of rotation (21) and by a blade plate (29) running tangentially with respect to the outer longitudinal margin (30) of the connecting plate (27).

15. The apparatus according to claim 14, wherein the longitudinal margin (30) of the connecting plates (27) runs parallel to the axis of rotation (21).

16. The apparatus according to claim 14, wherein the respective blade plate (29) has longitudinal edges (32) running obliquely with respect to the axis of rotation (21).

17. The apparatus according to claim 16, wherein the longitudinal edges (32) of successive blade plates (29) are inclined contradirectionally.

18. The apparatus according to claim 16, further comprising a gap (24) formed between the rear end (14) of the upper strand (17) of the conveyor (11) and the longitudinal edge (32), directed toward the rear end (14) of the upper strand (17), of the blade plates (29).

19. The apparatus according to claim 14, wherein the roller divider (20) is drivable in the dividing direction in such a way that the longitudinal edges (32), engaging on the end face (15) of the laundry batch, of the blade plates (29) run up with respect to the plane of the upper strand (17).

20. The apparatus according to claim 6, further comprising at least one means for reducing the width of the laundry batch transversely with respect to the transport direction (13) of the conveyor (11) arranged upstream of the divider (20).

21. A method for separating laundry articles (19) from a laundry batch, preferably a laundry cake (10), comprising the steps of:

first dividing the laundry batch by a dividing device (12) by gradually drawing the laundry articles (19) out of the laundry batch, and thereafter separating the laundry articles (19) of the divided laundry batch by a separating device.

22. The method according to claim 21, wherein the division of the laundry batch takes place according to a method comprising the steps of:

transporting the laundry batch from a conveyor (11) to a dividing device (12), and dividing the laundry batch from its end face (23) by the dividing device (12).

* * * * *